US005690009A

United States Patent [19]

Nakao et al.

[11] Patent Number: 5,690,009

[45] Date of Patent: Nov. 25, 1997

[54] ROLL SHEET CUTTER MECHANISM FOR USE IN IMAGE FORMING APPARATUS

[75] Inventors: Masahiko Nakao; Katsuhiro Yoshiuchi; Keizo Yamamoto, all of Osaka, Japan

[73] Assignee: Mita Industrial Co., Ltd., Osaka, Japan

[21] Appl. No.: 569,446

[22] Filed: Dec. 8, 1995

[30] Foreign Application Priority Data

Jan. 11, 1995 [JP] Japan ..... 7-002885

[51] Int. Cl.[6] ..... B26D 5/20; G03G 15/00

[52] U.S. Cl. ..... 83/76.8; 83/342; 83/349; 83/285; 399/385

[58] Field of Search ..... 83/76.1, 76.6, 83/76.8, 341, 342, 349, 368, 611, 285, 286, 289, 370, 290; 355/29; 399/385, 386

[56] References Cited

U.S. PATENT DOCUMENTS

| | | | |
|---|---|---|---|
| 3,507,573 | 4/1970 | Sage et al. | 83/342 X |
| 3,645,157 | 2/1972 | Di Giulio et al. | 399/386 X |
| 3,650,170 | 3/1972 | Hisabayashi | 83/349 |
| 3,722,340 | 3/1973 | Kobayashi | 355/29 X |
| 3,956,954 | 5/1976 | Edwards | 83/341 X |
| 4,268,163 | 5/1981 | Doi et al. | 355/14 |
| 4,297,930 | 11/1981 | Putzke | 83/156 |
| 4,362,076 | 12/1982 | Sasaki et al. | 83/342 X |
| 4,464,959 | 8/1984 | Larson | 83/76.8 X |
| 4,512,225 | 4/1985 | Green | 83/76.8 X |
| 4,969,016 | 11/1990 | Kudoh | 83/342 X |
| 5,300,012 | 4/1994 | Kamada | 493/459 |
| 5,386,753 | 2/1995 | Baron et al. | 83/342 X |

FOREIGN PATENT DOCUMENTS 245261 1/1926 United Kingdom .

*Primary Examiner*—Eugenia Jones

*Attorney, Agent, or Firm*—Beveridge, Degrandi, Weilacher & Young, LLP

[57] ABSTRACT

A roll sheet cutter mechanism for an image forming apparatus is provided which is adapted to cut a roll sheet 4 paid out of a feed reel 51 between a rotary blade 82 and a stationary blade 81. When the leading edge of the transported roll sheet 4 passes over the rotary blade 82 located at a guiding position, the rotary blade 82 guides the leading edge of the roll sheet 4 in a transportation direction. The rotary blade 82 returns to a cutting stand-by position before the tail edge portion of the roll sheet 4 passes over the rotary blade 82. Therefore, the occurrence of jam of the roll sheet due to the curling thereof can assuredly be prevented. Further, time loss can be eliminated because the rotary blade is adapted to return to the cutting stand-by position.

3 Claims, 7 Drawing Sheets

ROLL SHEET CUTTER MECHANISM FOR USE IN IMAGE FORMING APPARATUS

BACKGROUND OF THE INVENTION

1. Field of the Invention

The present invention relates to a roll sheet cutter mechanism for cutting an elongated continuous transfer sheet such as a roll paper sheet, which is applied to an image forming apparatus for forming an image on such a continuous transfer sheet.

2. Description of the Prior Art

Conventional electrostatic-type image forming apparatuses in wide use are adapted to form an image on a transfer sheet in the following manner. An electrostatic latent image is first formed on the surface of a photoreceptor. The electrostatic latent image is developed into a toner image, which is then thermally fixed on a transfer sheet. Thus, an image is formed on the transfer sheet.

Recently, electrostatic-type image forming apparatuses capable of forming an image on a large-size transfer sheet such as of JIS A0 size have become available. "JIS A0 size", which is one of the sheet sizes (finished dimensions) specified by Japanese Industrial Standards, is 841 mm×1189 mm.

Since it is difficult to handle such large-size transfer sheets as of A0 size one by one, a roll sheet into which an elongated continuous transfer sheet is rolled is generally used.

A mechanism for cutting a wide roll-sheet having a A0-size width as shown in FIG. 7 has been provided, which comprises an elongated stationary blade 901 provided on one side of a transportation path and extending in a transverse direction of the A0-size-wide roll sheet 900, and a rotary blade 903 disposed opposite to the stationary blade 901 on the other side of the transportation path and adapted to rotate about an axis 902 extending parallel to the transverse direction of the roll sheet 900 to cooperate with the stationary blade 901 to cut the roll sheet 900 therebetween. The rotary blade 903 has a base 904 rotatable about the axis 902 and a blade portion 905 projecting from a surface of the base 904 and carried thereby.

The transportation path is partitioned by a plurality of guide plates. A guide plate 906 adjacent to the rotary blade 903 is spaced apart from a rotation track 908 of an edge 907 of the rotary blade 903 by a predetermined clearance to prevent the interference with the blade edge 907. When the leading edge 909 of the roll sheet 900 passes over the rotary blade 903, the surface of the base 904 faces opposite to the guide plate 906, and the amount 910S of the clearance 910 between the surface of the base 904 and the guide plate 906 is large.

Therefore, the leading edge 909 of the transported roll sheet 900 is liable to enter the clearance 910 to cause jam.

In particular, where the roll sheet 900 is upwardly fed as shown in FIG. 7, the leading edge 909 of the roll sheet 900 is prone to sag by its own gravity and thereby to enter the clearance 910. The roll sheet 900 transported through the transportation path may have a curl which is set when the sheet is in a rolled state and, in such a case, the leading edge 909 of the roll sheet 900 is liable to enter the clearance 910.

It is, therefore, an object of the present invention to provide a roll sheet cutter mechanism for an image forming apparatus which can prevent a roll sheet from jamming around a rotary blade thereof.

SUMMARY OF THE INVENTION

In accordance with a first feature of the present invention, there is provided a roll sheet cutter mechanism for cutting an elongated roll sheet paid out of a feed reel and transported in a predetermined transportation direction along a transportation path, comprising: an elongated stationary blade disposed on one side of the transportation path and extending in a direction perpendicular to the transportation direction; a rotary blade disposed opposite to the stationary blade on the other side of the transportation path and adapted to rotate about an axis extending parallel to the longitudinal direction of the stationary blade along a rotational direction corresponding to the transportation direction to cooperate with the stationary blade to cut the roll sheet therebetween at a cutting position; rotary blade driving means for rotatively driving the rotary blade; and control means for controlling the operation of the rotary blade driving means; wherein the control means stops the rotary blade at a guiding position downstream of the cutting position along the rotation direction for guiding the roll sheet to the transportation direction during a period between a first time point a predetermined time period before the leading edge of the roll sheet passes over the rotary blade and a second time point a predetermined time period after the leading edge of the roll sheet passes over the rotary blade.

In the roll sheet cutter mechanism with the aforesaid feature, the rotary blade is stopped at the guiding position downstream of the cutting position along the rotational direction during the predetermined period before and after the leading edge of the fed roll sheet passes over the rotary blade and, therefore, the leading edge of the roll sheet passing over the rotary blade is guided to the transportation direction by the rotary blade. Thus, the occurrence of jam can be prevented.

In accordance with a second feature of the present invention, the aforesaid roll sheet cutter mechanism is characterized in that the winding direction of the roll sheet wound around the feed reel is such that the forward portion of the roll sheet is curled to be directed toward the rotary blade.

In the roll sheet cutter mechanism with the aforesaid feature, the rotary blade located at the guiding position guides the leading edge of the roll sheet to the transportation direction even if the roll sheet has a curl which is directed toward the rotary blade.

In accordance with a third feature of the present invention, the aforesaid roll sheet cutter mechanism is characterized in that the control means starts driving the rotary blade driving means just before the leading edge of the roll sheet passes over the rotary blade after the second time point to move the rotary blade to a cutting stand-by position upstream of the cutting position along the rotational direction.

In the roll sheet cutter mechanism with the aforesaid feature, the rotary blade is moved to the cutting stand-by position upstream of the cutting position along the rotary direction, and waits for a portion of the roll sheet to be cut off to pass thereover.

According to the first feature of the present invention, the leading edge of the fed roll sheet is guided in the transportation direction by the rotary blade for cutting the roll sheet, whereby the occurrence of jam can be assuredly prevented.

According to the second feature of the present invention, even if the roll sheet is curled to be directed toward the rotary blade, the leading edge of the roll sheet can assuredly be guided in the transportation direction by the rotary blade located at the guiding position. Further, less consideration is required for determining the winding direction of the roll sheet, allowing for free layout of the roll sheet in a copying machine.

According to the third feature of the present invention, the rotary blade which guides the leading edge of the roll sheet at the guiding position returns to the cutting stand-by position before the tail edge portion of the roll sheet passes over the rotary blade. Therefore, time loss can be eliminated which may occur where the rotary blade is used to guide the roll sheet.

DESCRIPTION OF THE PREFERRED EMBODIMENTS

An embodiment of the present invention will hereinafter be described with reference to the attached drawings.

Figure 1:
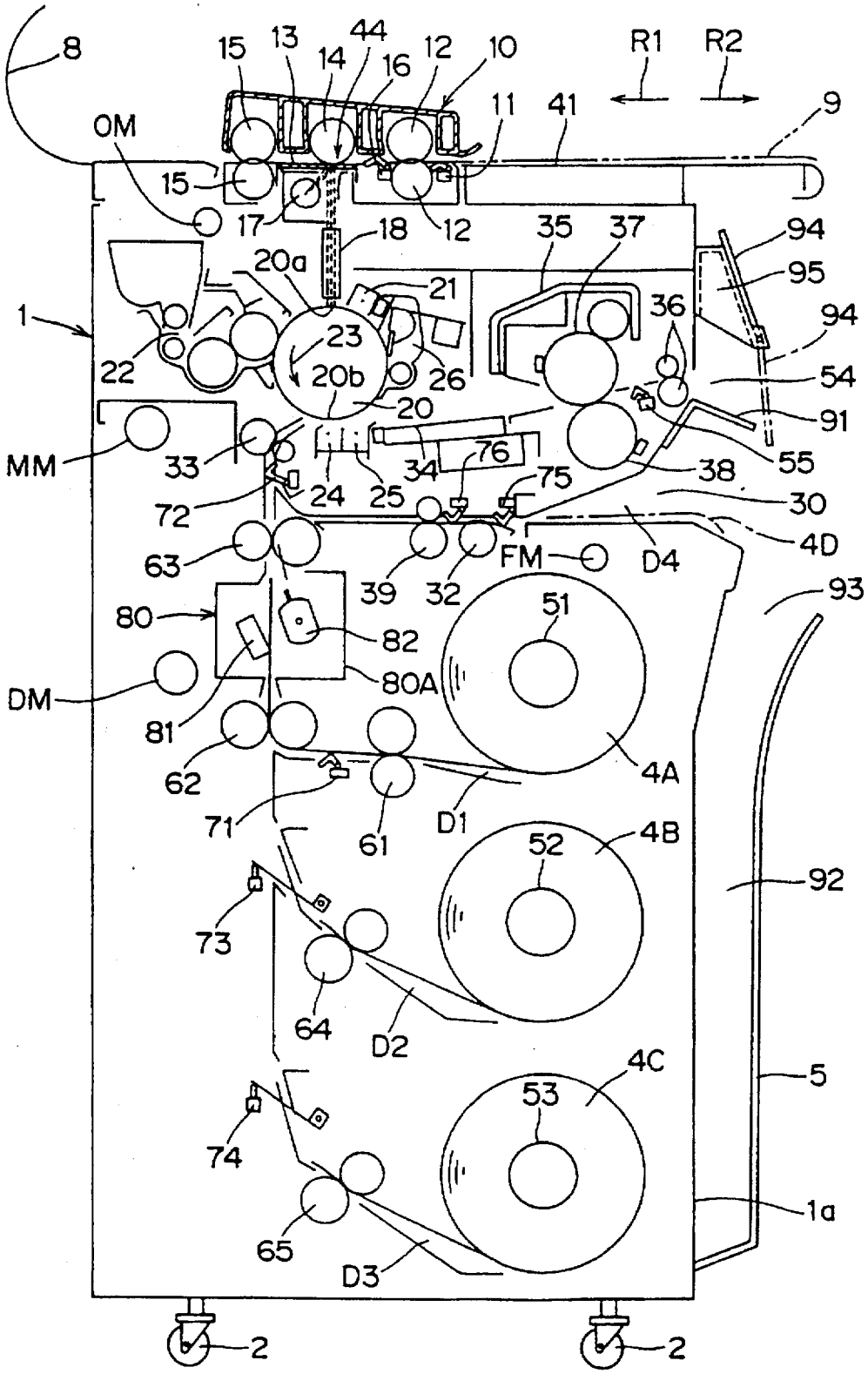
FIG. 1 is a schematic sectional view illustrating the internal construction of a copying machine to which a roll sheet cutter mechanism according to one embodiment of the present invention is applied.
Figure 2:
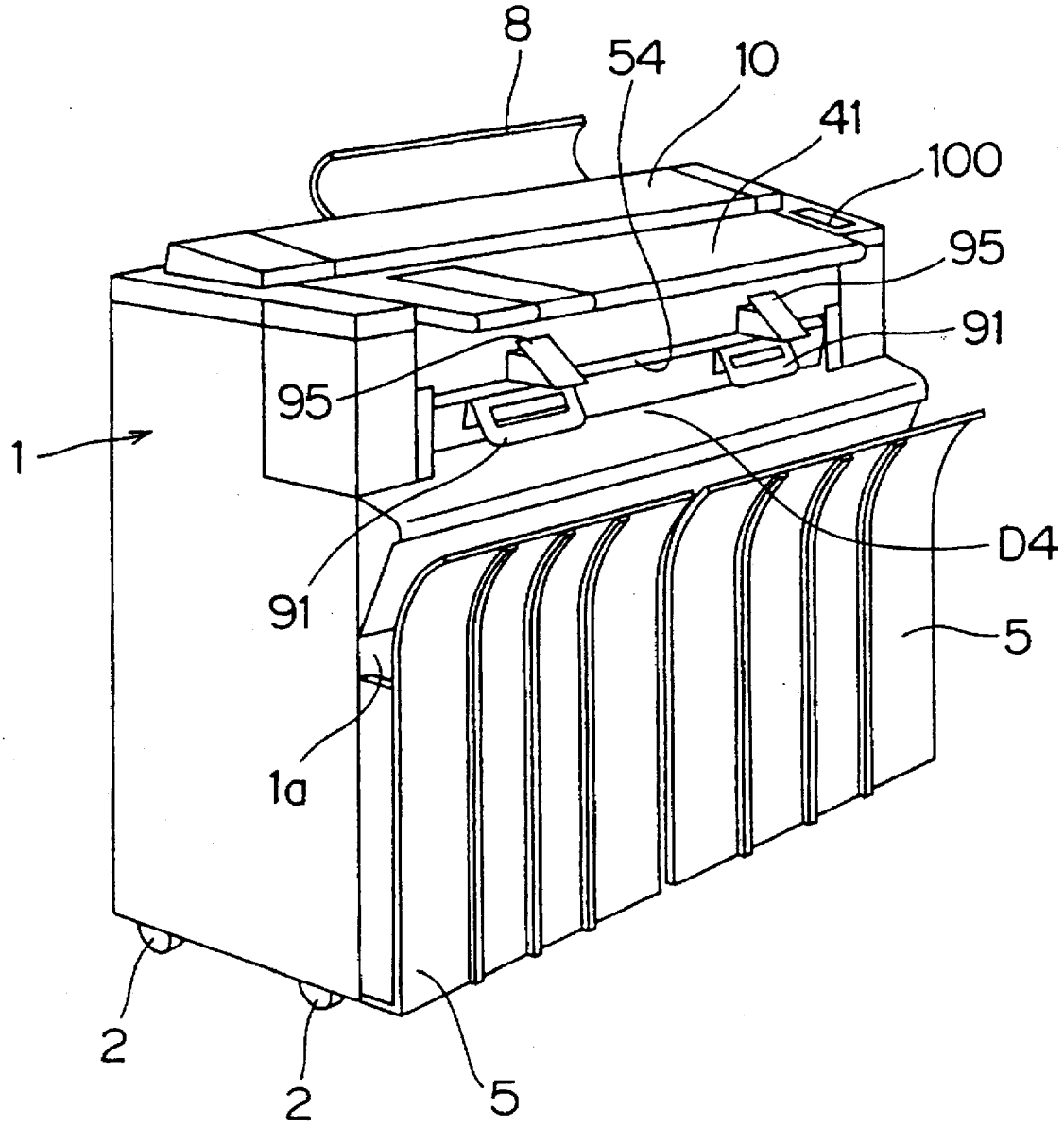
FIG. 2 is a perspective view illustrating the external construction of the copying machine.
Figure 3:
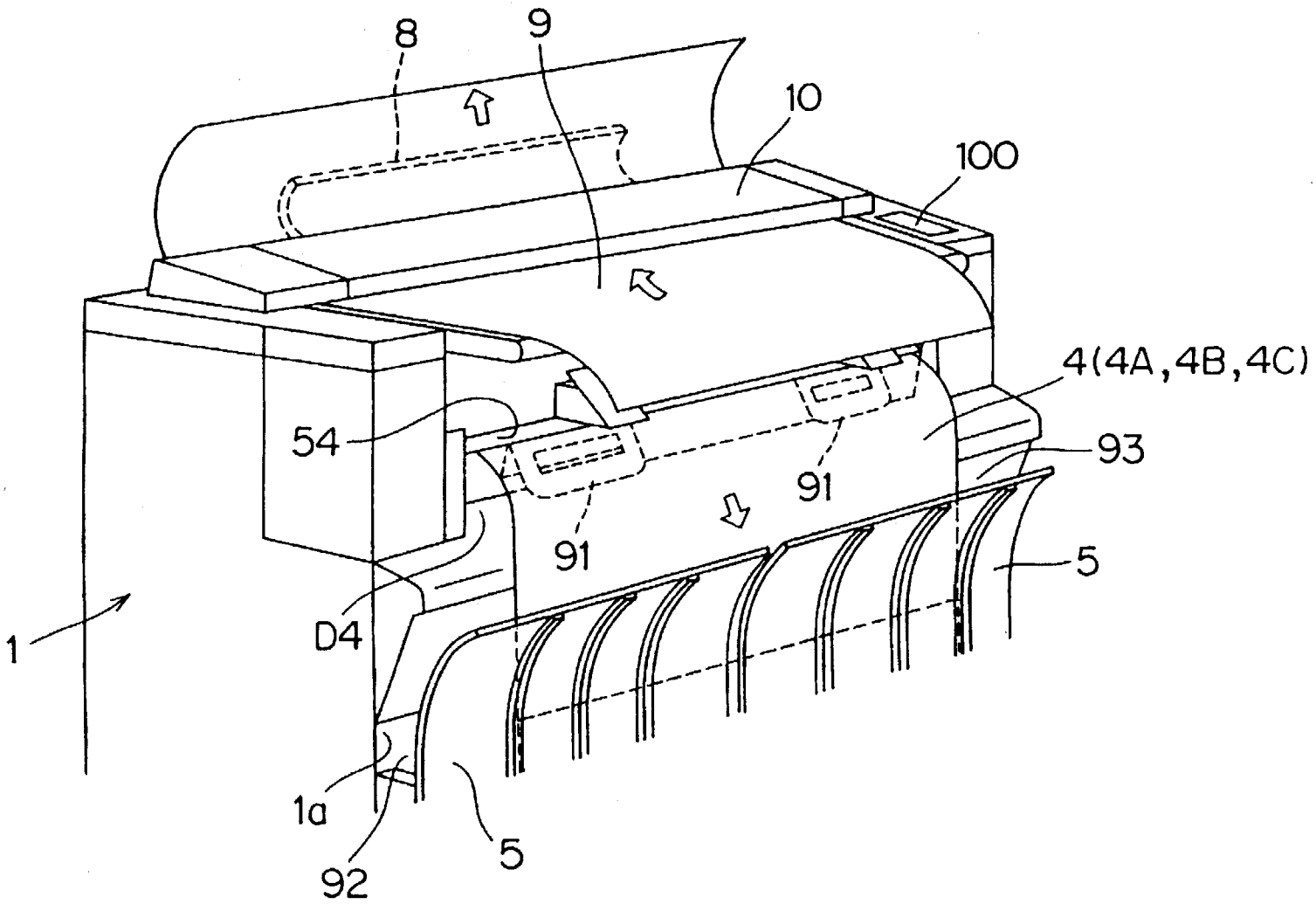
FIG. 3 is a perspective view illustrating the appearance of the copying machine in a use state.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of A0 size. In the copying machine, the document original is scanned under light irradiation by a stationary optical system while being transported, and an image is formed on the basis of the optical scanning.

Referring to FIG. 1, a machine body 1 has caster wheels 2 on the under side thereof for free movement. Referring to FIGS. 1 to 3, a document-original transportation section 10 for transporting a document original 9 along a document-original transportation path 41 formed on the top face of the machine body 1 is provided on the machine body 1. A discharge port 54 for discharging a sheet having a toner image transferred thereon opens in a front face 1*a* of the machine body 1. The sheet discharged from the discharge port 54 is guided by a guide member 91, dropped through a guide opening 93 with the leading edge thereof oriented downward, and accommodated in a pocket 92 defined by a front cover 5 provided along the front face 1*a* of the machine body 1, as shown in FIG. 3. On an edge portion of the top face of the machine body 1 is provided with an operation section 100 having switches, keys and the like for making various settings related to a copying operation.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face 1*a* of the machine body 1.

The roll sheet 4A in the upper position is transported along a first transportation path D1 to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order.

The roll sheet 4B in the middle position is transported along a second transportation path D2 to the photoreceptor drum 20 through the feed reel 52, sheet feeding rollers 64, a third leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The roll sheet 4C in the lower position is transported along a third transportation path D3 to the photoreceptor drum 20 through the feed reel 53, sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The bypass transportation path D4 is a path which leads the cut-sheet 4D introduced from the manually sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path D1.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4" when the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharger 24 for image transfer is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger 24 for image transfer, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger 54 for image transfer with being brought into contact with the surface of the photoreceptor drum 20. Then, the toner image formed on the surface of the photoreceptor drum 20 is transferred onto the sheet 4 by way of corona discharge by the corona discharger 24 for image transfer. The sheet 4 having the toner image transferred thereon is removed from the surface of the photoreceptor drum 20 by way of corona discharge by a corona discharger 25 for sheet removal, and then led to a fixing unit 35 through the transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide member 91, and accommodated in the pocket 92, as described above. After the toner image is transferred, the toner remaining on the surface of the photoreceptor drum 20 is removed by a cleaning unit 26 for the next electrostatic latent image formation.

Similarly, the cut-sheet 4D led to the photoreceptor drum 20 from the bypass sheet feeding path D4 is subjected to the toner image transfer and the toner fixation, and then discharged into the pocket 92.

Above the guide member 91 is disposed an auxiliary guide plate 94. The auxiliary guide plate 94 is pivotally supported by a stay 95 attached to the front face 1*a* of the machine body 1. The auxiliary guide plate 94 assumes either an attitude (indicated by a dashed line in FIG. 1) for guiding the discharged sheet 4 hanging down forwardly of the guide member 91 into the pocket 92 cooperatively with the guide member 91 or an attitude (indicated by a solid line in FIG. 1) for sheet accommodation in which the auxiliary guide plate 94 is supported by the stay 95. The attitude of the auxiliary guide plate 94 can be shifted by the pivotal movement thereof.

Image forming means is constituted by such members as the photoreceptor drum 20, the developing unit 22 and the corona discharger 24 for image transfer. In this embodiment, the copying machine further includes a main motor MM for driving the image forming means, a sheet feeding motor DM for driving the transportation rollers for feeding the sheet 4A, 4B, 4C and 4D, a fixation motor FM for driving the heat roller 37 and press roller 38 of the fixing unit 35, and a document-original feeding motor OM for driving the document original transportation section 10.

There will next be described the cutter mechanism 80 serving as the roll sheet cutter mechanism in accordance with the present invention.

Figure 4:
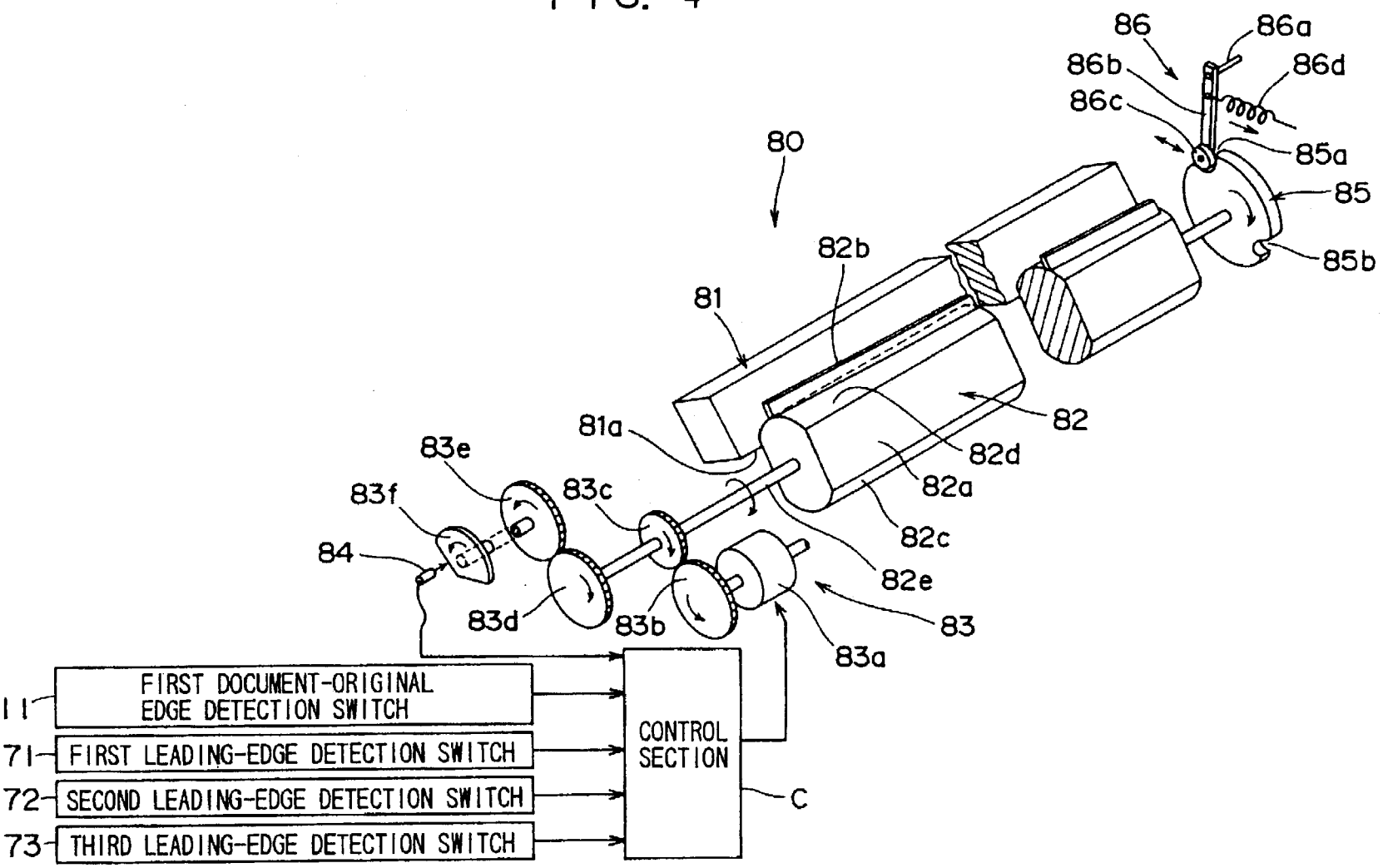
FIG. 4 is a schematic perspective view illustrating the construction of the roll sheet cutter mechanism along with a block diagram.

Referring to FIGS. 1 and 4, the cutter mechanism 80 comprises a casing 80A, the stationary blade 81, the rotary blade 82, a driving system 83 serving as the rotary blade driving means for driving the rotary blade 82, and a rotational position detection sensor 84 for detecting the rotational position of the rotary blade 82.

The stationary blade 81 and the rotary blade 82 are housed in the casing 80A fixed in the copying machine body 1, and integrated as a single unit. The stationary blade 81 is formed into an elongated parallelepiped extending in a direction perpendicular to the plane of FIG. 1 and disposed on the left side of the first sheet feeding path D1 in FIG. 1.

The rotary blade 82 includes an elongated bar base 82*a* having a pair of flat surfaces 82*c* and a pair of opposing curved surfaces 82*d*, and a planar blade portion 82*b* generally diametrically extending and fixed onto one curved surface 82*c* of the base 82*a*. The roll sheet 4 is cut between an edge of the blade portion 82*b* and a lower edge 81*a* of the stationary blade 81 (see FIG. 6(*c*)). The blade portion 82*b* is fixed onto the base 82*a* diagonally offset with respect to the longitudinal direction thereof, thereby allowing the roll sheet 4 to be cut exactly perpendicular to the longitudinal direction thereof by the rotary blade 82 while the roll sheet 4 is transported.

The winding directions of the roll sheets 4A, 4B and 4C respectively wound around the feed reels 51, 52 and 53 are such that the forward portion of the transported roll sheets 4A, 4B and 4C are curled to be directed toward the rotary blade 82.

Gears 83*c* and 83*d* are fixed to a rotary shaft 82*e* projecting from one end of the base 82*a* for united rotation. The driving force of the sheet feeding motor DM is transmitted to the gear 83*c* via a gear 83*b* and an electromagnetic clutch 83*a* such as a spring clutch. The gear 83*d* gears with a gear 83*e* to which a fan-shaped detection plate 83*f* is fixed for united rotation. The rotational position detection sensor 84 is disposed in a position opposable to the detection plate 83*f*. The rotational position detection sensor 84 comprises a photosensor or the like, and is adapted to output a signal indicative of whether or not the detection plate 83*f* is opposed thereto. The clutch 83*a*, gears 83*b* and 83*c* and the like constitute the driving system 83.

Figure 6A:
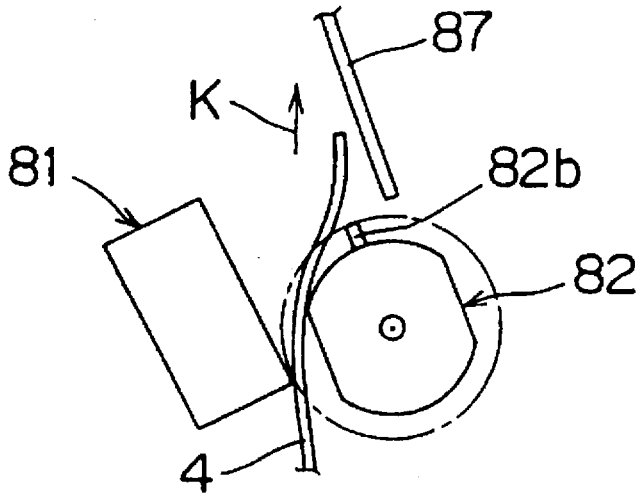
FIGS. 6(*a*), 6(*b*) and 6(*c*) illustrate successive rotational movements of a stationary blade and a rotary blade.
Figure 6B:
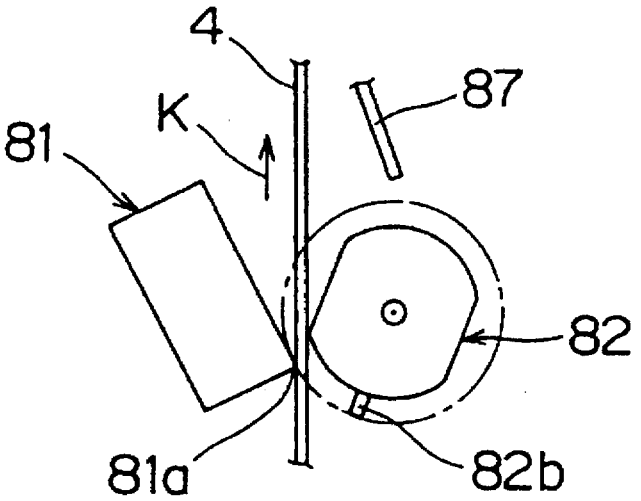
Figure 6C:
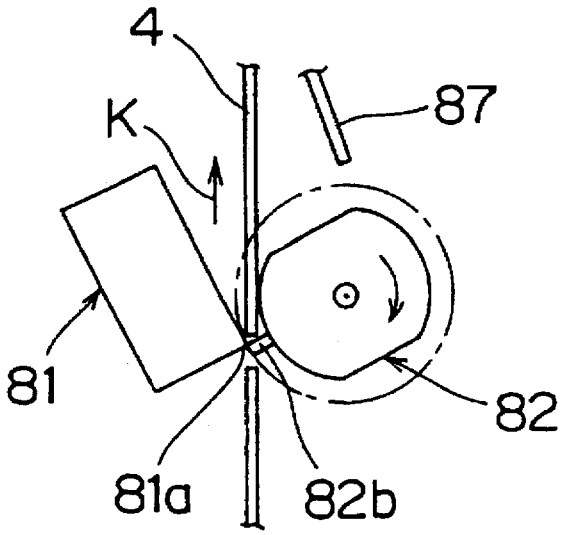
Figure 7:
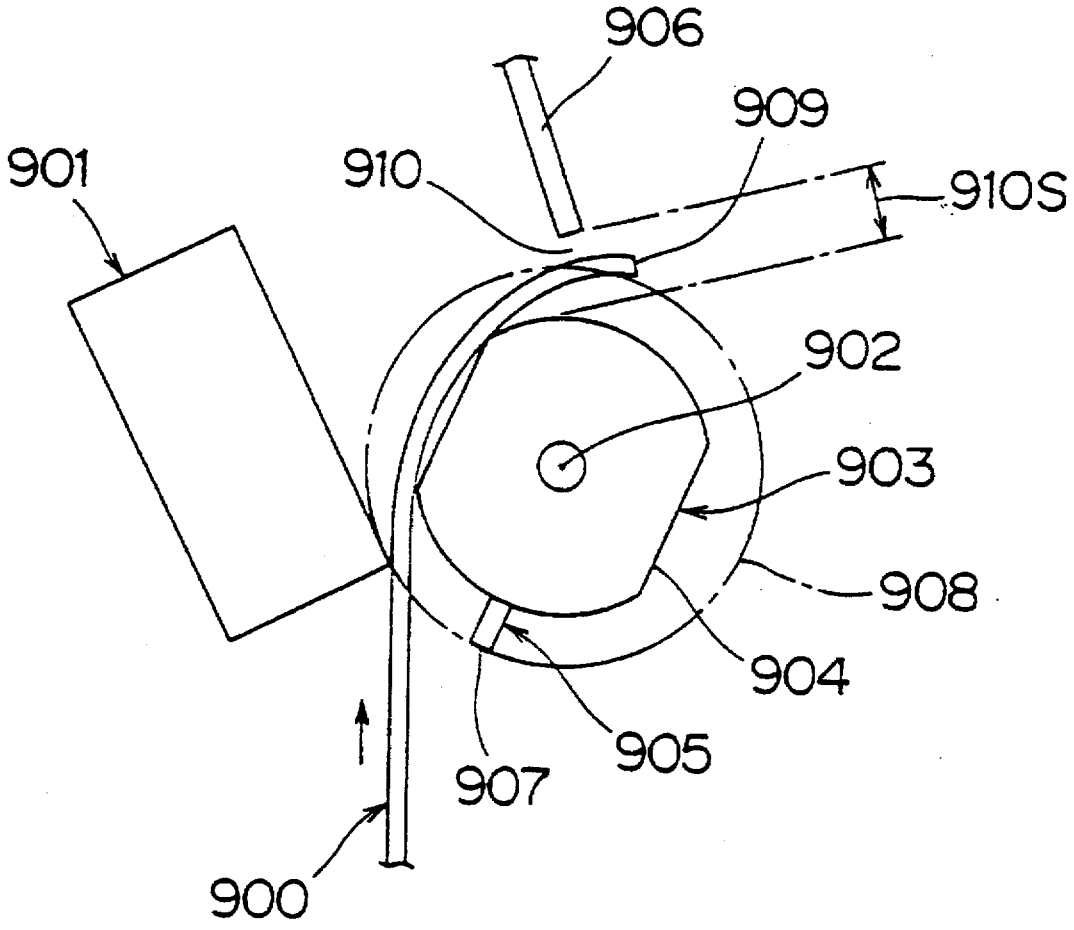
FIG. 7 (PRIOR ART)
FIG. 7 is a schematic diagram illustrating a conventional roll sheet cutter mechanism.

A disk 85 formed with a pair of recesses 85*a* and 85*b* in predetermined positions on the periphery thereof is fixed to the other end of the rotary shaft 82*e* for united rotation. A stopper mechanism 86 is provided which is capable of positioning the disk 85 and the rotary blade 82 in predetermined rotational positions by engaging with the recesses 85*a* and 85*b* with a predetermined engaging force. The recess 85*a* serves to locate the rotary blade 82 at the guiding position shown in FIGS. 4 and 6(*a*). As shown in FIG. 6(*a*), the blade portion 82*b* of the rotary blade 82 located at the guiding position guides the leading edge of the transported roll sheet 4 to the guide plate 87 downstream in the transportation direction.

The recess 85*b* serves to locate the rotary blade 82 at the cutting stand-by position shown in FIG. 6(*b*).

The stopper mechanism 86 has a pivotal lever 86*b* pivotal about the shaft 86*a* at one end thereof, a roller 86*c* rotatably supported by the other end of the pivotal lever 86*b* and rolling around the periphery of the disk 85, and a tension coil spring 86*d* biasing the pivotal lever 86*b* in a direction such that the roller 86*c* is pressed against the periphery of the disk 85.

The rotational position detection sensor 84, the first document-original edge detection switch 11, the first leading-edge detection switch 71, the second leading-edge detection switch 72 and the third leading-edge detection switch 73 are connected to a control section C for controlling the operation of the cutter mechanism 80, to which signals are input from various sensors. Further connected to the control section is a clutch 83*a* and a signal for switching on and off the clutch 83*a* is output from the control section C.

An explanation will next be given to the operation of the cutter mechanism 80 with reference to the timing chart shown in FIG. 5 and FIG. 6.

In the initial state, the rotary blade 82 is located at the Guiding position as shown in FIGS. 4 and 6(*a*). When the document original 9 is set and the first document-original edge detection switch 11 is switched on, the transportation roller 12 is driven and the transportation of the document original 9 in the regular transportation direction R1 is started. Thereafter, in response to the leading edge of the document original 9 being detected by the second document-original edge detection switch 16, the transportation of the roll sheet 4 is started. (The timing chart of the second document-original edge detection switch 16 is not shown in FIG. 5.)

Figure 5:
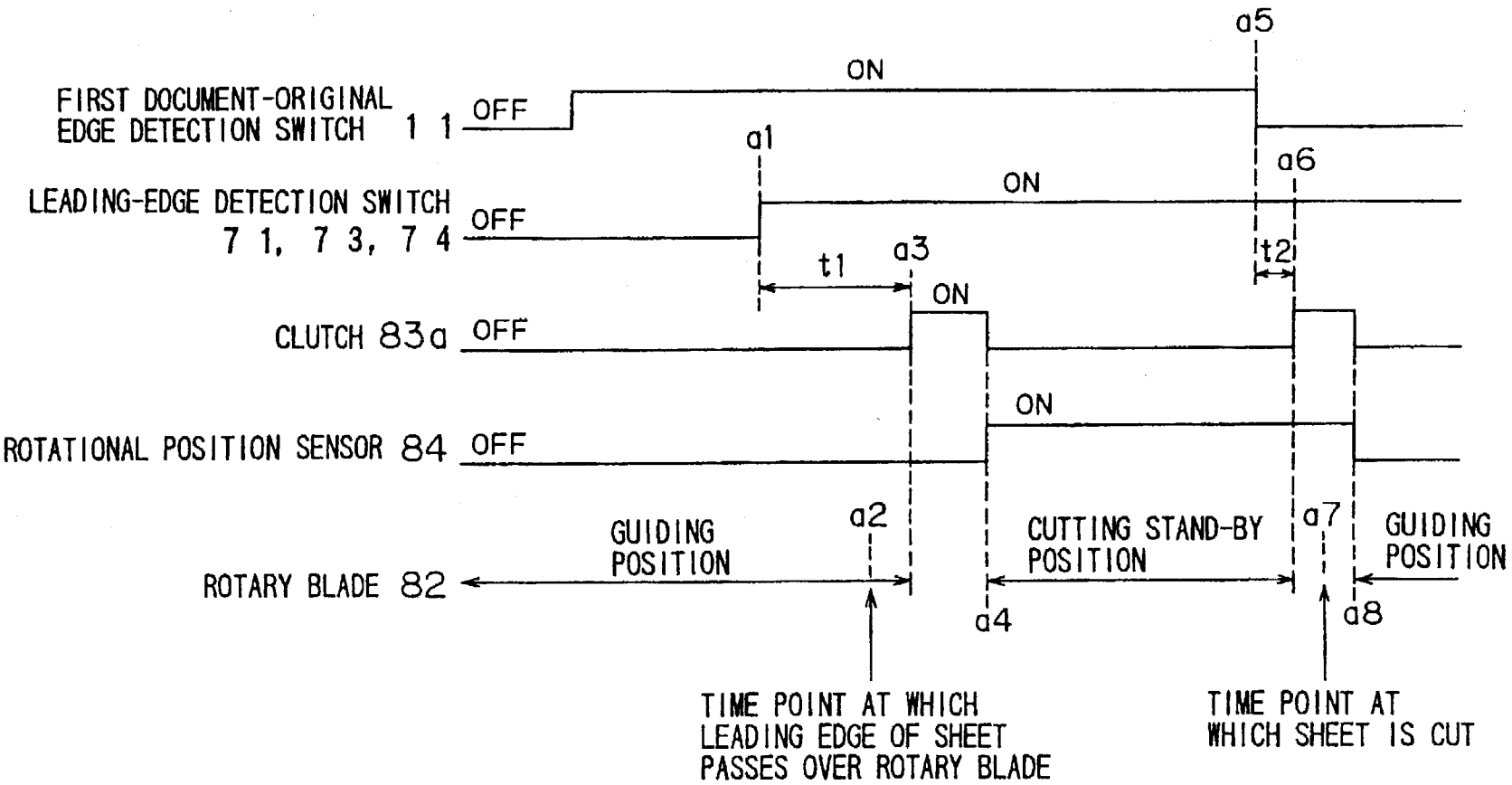
FIG. 5 is a timing chart illustrating the operation of the roll sheet cutter mechanism.

The leading edge of the transported roll sheet 4 is detected by corresponding one of the first leading-edge detection switch 71, the third leading-edge detection switch 73 and the fourth leading-edge detection switch 74 (at a time point a1 shown in FIG. 5). The clutch 83*a* is switched on at a time point a3 a predetermined time period t1 after the time point a1 (the time point a3 corresponds to the second time point). In response thereto, the rotation of the rotary blade 82 is started. At a time point a4 at which the rotational position detection sensor 84 is switched on, the clutch 83*a* is switched off, and the roller 86*c* of the stopper mechanism 86 is engaged with the recess 85*b* of the disk 85, thereby stopping the rotary blade 82 at the cutting stand-by position.

The time period t1 is predetermined such that a time point a2 at which the leading edge of the roll sheet 4 passes over the rotary blade 82 is set before the time point a3. Therefore, the leading edge of the roll sheet 4 is guided to the guide plate 87 provided downstream of the rotary blade 82 by the blade portion 82*b* of the rotary blade 82 located at the guiding position without jamming as shown in FIG. 6(*a*).

Since the lengths of the sheet feeding paths respectively extending from the first, third and fourth leading-edge detection switches 71, 73 and 74 to the rotary blade 82 are different, the predetermined time period t1 has different values depending on the lengths of the paths. The value of the time period t1 is properly determined in correspondence with the leading-edge detection switch 71, 73 or 74 which has been switched on.

The clutch 83*a* is switched on at a time point a6 a predetermined time period t2 after a time point a5 at which the tail edge of the document original 9 transported in the regular transportation direction R1 is detected by the first document-original edge detection switch 11. The rotary blade 82 is thereby rotated and, when the rotary blade 82 passes over the cutting position shown in FIG. 6(*c*) during the rotation, the tail edge portion of the roll sheet 4 is cut at a time point a7. At a time point a8 at which the rotational position detection sensor 84 is switched off (the time point a8 corresponds to the first time point), the clutch 83*a* is switched off, and the roller 86*c* of the stopper mechanism 86 is engaged with the recess 85*a* of the disk 85, thereby stopping again the rotary blade 82 at the guiding position.

According to this embodiment, the leading edge of the fed roll sheet 4 is guided in the transportation direction by the rotary blade 82 for cutting the roll sheet 4, whereby the occurrence of jam around the rotary blade can assuredly be prevented.

Even if the roll sheet 4 having a curl which is set when the sheet is in a rolled state is directed toward the rotary blade 82 as in this embodiment, the leading edge of the roll sheet 4 can assuredly be guided in the transportation direction. Further, less consideration is required for determining the winding direction of the roll sheet, allowing for free layout of the roll sheet in a copying machine.

The rotary blade 82 which guides the leading edge of the roll sheet 4 at the guiding position returns to the cutting stand-by position before the tail edge portion of the roll sheet 4 passes over the rotary blade. Therefore, time loss can be eliminated which may occur where the rotary blade 82 is used to guide the roll sheet 4.

The foregoing embodiment is not limitative of the present invention and various modifications can be made thereto, for example, in which a dedicated driving motor for the rotary blade 82 may be provided and a stepping motor may be employed as the driving motor.

Though a copying machine is taken as an example of the image forming apparatus in the foregoing description, the present invention is applicable to any other image forming apparatuses such as printing machine, which are adapted to form an image on a particularly large-size transfer sheet.

What is claimed is:

1. A roll sheet cutter mechanism for cutting an elongated roll sheet paid out from a feed reel and transported in a predetermined transportation direction along a transportation path that includes a guide-plate, which is disposed in the transportation path at a position downstream of the roll sheet cutter mechanism along the transportation direction, the roll sheet cutter mechanism and the guide plate forming a gap therebetween, the being large enough to permit entry of a leading edge of the roll sheet, the roll sheet cutter mechanism comprising:

an elongated stationary blade disposed on one side of the transportation path and extending in a direction perpendicular to the transportation direction;

a rotary blade, disposed opposite to the stationary blade on the other side of the transportation path and adapted to rotate about an axis extending parallel to the longitudinal direction of the stationary blade, for cutting, at a cutting position, the roll sheet in cooperation with the stationary blade, the rotary blade having a blade portion;

rotary blade driving means for rotatably driving the rotary blade along a rotational direction such that the blade portion thereof moves along the transportation direction when the blade portion is in the transportation path; and control means for controlling the operation of the rotary blade driving means;

the control means controlling the rotary blade driving means to cause the rotary blade to stop at a guiding position downstream of the cutting position along the rotational direction so as to guide the roll sheet in the transportation direction during a period between a first time point that is a predetermined time period before a leading edge of the roll sheet passes over the rotary blade and a second time point that is a predetermined time period after the leading edge of the roll sheet passes over the rotary blade, wherein the rotary blade at the guiding position covers the gap and guides the leading edge of the roll sheet toward a surface opposite to the transportation path of the guide plate to thereby prevent the roll sheet leading edge from entering the gap;

the control means further controlling the rotary blade driving means to cause the rotary blade to start rotation in the rotational direction after the second time point so that the rotary blade is led to a cutting stand-by position before a tail edge portion of the roll sheet passes over the rotary blade, the cutting stand-by position being upstream of the cutting position along the rotational direction.

2. A roll sheet cutter mechanism as set forth in claim 1, wherein a winding direction of the roll sheet wound around the feed reel is such that a forward portion of the roll sheet is curled according to the winding direction of the roll sheet around the feed reel;

the roll sheet cutter mechanism further comprising means for transporting the roll sheet paid out from the feed reel toward between the stationary blade and the rotary blade such that the leading edge of the curled forward portion is directed toward the rotary blade.

3. A roll sheet cutter mechanism as set forth in claim 1, wherein the control means stops the rotary blade at the cutting stand-by position.

* * * * *